US010161352B2

(12) United States Patent
Clever et al.

(10) Patent No.: US 10,161,352 B2
(45) Date of Patent: Dec. 25, 2018

(54) ENGINE BLOCK ASSEMBLY

(71) Applicant: GM GLOBAL TECHNOLOGY OPERATIONS LLC, Detroit, MI (US)

(72) Inventors: Glenn E. Clever, Washington, MI (US); Patricia A. Stark, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 674 days.

(21) Appl. No.: 14/523,988

(22) Filed: Oct. 27, 2014

(65) Prior Publication Data

US 2016/0115854 A1 Apr. 28, 2016

(51) Int. Cl.

*F02B 75/18* (2006.01)
*F02F 1/14* (2006.01)
*F02F 1/10* (2006.01)

(52) U.S. Cl.

CPC ..... *F02F 1/14* (2013.01); *F02F 2001/104* (2013.01)

(58) Field of Classification Search

USPC ..... 123/41.72, 41.74, 41.79, 41.78
See application file for complete search history.

(56) References Cited

U.S. PATENT DOCUMENTS 4,253,431 A 3/1981 Mettig et al.
8,312,848 B2 * 11/2012 Weed ..... F02B 75/18 123/41.72
2002/0000210 A1 * 1/2002 Shinpo ..... F01P 3/02 123/41.74
2005/0217615 A1 * 10/2005 Matsutani ..... F01P 3/02 123/41.74
2008/0283001 A1 * 11/2008 Konishi ..... F02F 1/108 123/41.72
2009/0194046 A1 * 8/2009 Shikida ..... F02F 1/14 123/41.74
2010/0095912 A1 4/2010 Nomura et al.
2015/0330289 A1 * 11/2015 Bandyopadhyay ..... F02M 21/0215 123/41.72

FOREIGN PATENT DOCUMENTS

CN 101490379 A 7/2009
CN 102072039 A 5/2011
CN 102192037 A 9/2011

* cited by examiner

*Primary Examiner* — Lindsay Low
*Assistant Examiner* — Ruben Picon-Feliciano
(74) *Attorney, Agent, or Firm* — Quinn IP Law

(57) ABSTRACT

An engine block assembly includes an engine block casting including a plurality of cylinder bores disposed in series, each cylinder having a cylinder wall. Outer engine block walls are peripheral to the cylinder walls. A channel is formed between outer peripheral surfaces of the cylinder walls and the outer engine block walls. A coolant passage fluidly connects through the outer block walls to the channel. A water jacket insert includes an upper flange, a strut portion and a lower flange. A plurality of orifices are formed in the strut portion. A compressible seal attached to the lower flange of the water jacket insert, which is assembled into the channel and conforms to a bottom portion of the channel.

18 Claims, 2 Drawing Sheets

ENGINE BLOCK ASSEMBLY

TECHNICAL FIELD

This disclosure relates to engine block assemblies for internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine blocks and other devices that are formed by sand-cast molding, die-cast molding and other forming methods can experience dimensional variation in certain cavities such as coolant passages. Engine manufacturers insert coolant diverters into engine blocks to direct and meter coolant flow to portions of the engine block and other engine components to target coolant flow and hence target heat transfer to and from specific locations. Coolant leaking may occur around a coolant diverter that is inserted into a cavity that is subject to dimensional variation, thus reducing the effect of the targeted heat transfer.

SUMMARY

An engine block assembly is described, and includes an engine block casting including a plurality of cylinder bores disposed in series, each cylinder having a cylinder wall. Outer engine block walls are peripheral to the cylinder walls. A channel is formed between outer peripheral surfaces of the cylinder walls and the outer engine block walls. A coolant passage fluidly connects through the outer block walls to the channel. A water jacket insert includes an upper flange, a strut portion and a lower flange. A plurality of orifices are formed in the strut portion. A compressible seal is attached to the lower flange of the water jacket insert. The water jacket insert is assembled into the channel. The compressible seal of the water jacket insert conforms to a bottom portion of the channel. The water jacket insert defines a first coolant chamber fluidly connected to the coolant passage and a second coolant chamber adjacent to the outer peripheral surfaces of the cylinder walls with the first and second coolant chambers fluidly connected through the orifices.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

DETAILED DESCRIPTION

Figure 1:
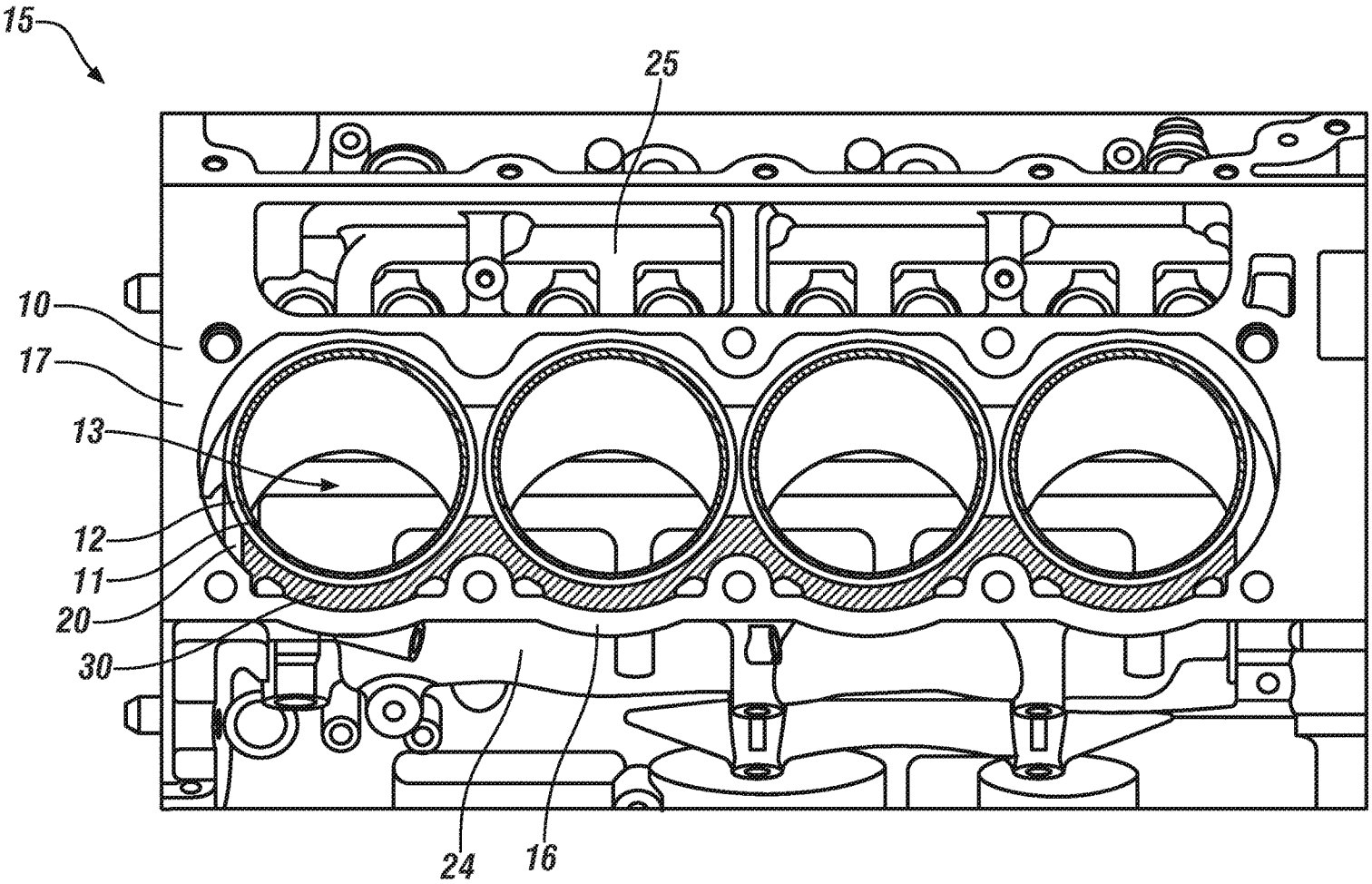
FIG. 1 schematically illustrates a top plan view of a multi-cylinder engine block assembly, in accordance with the disclosure.
Figure 2A:
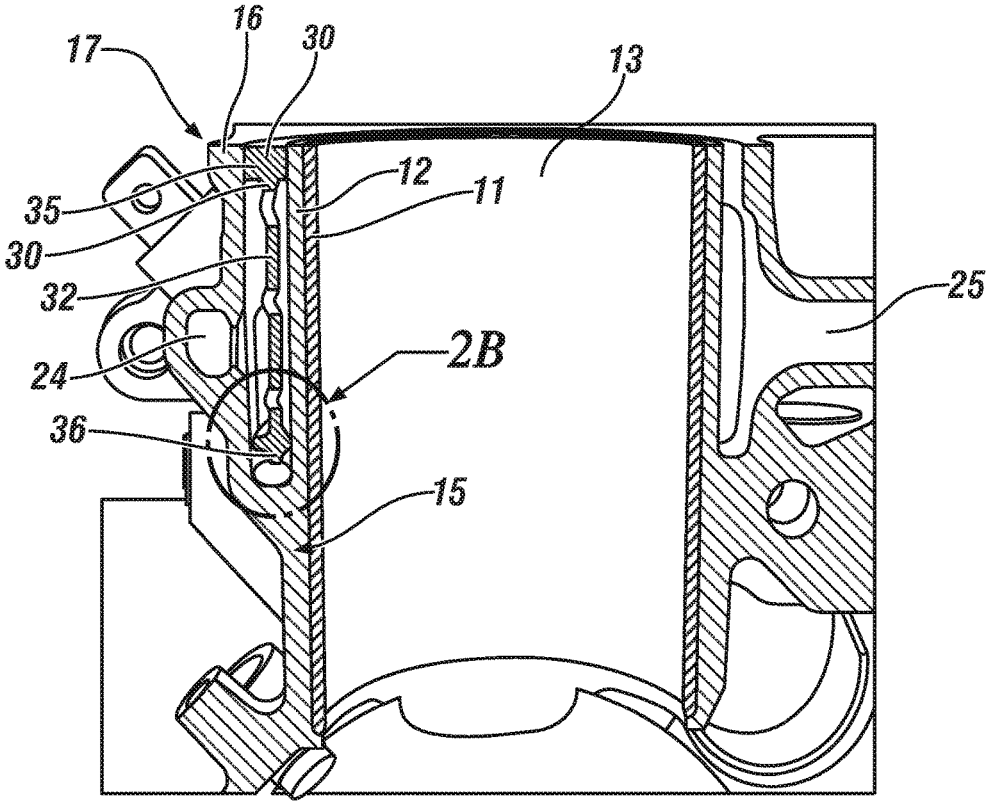
FIGS. 2A and 2B schematically illustrate a partial cutaway end view of the engine block assembly, in accordance with the disclosure.
Figure 2B:
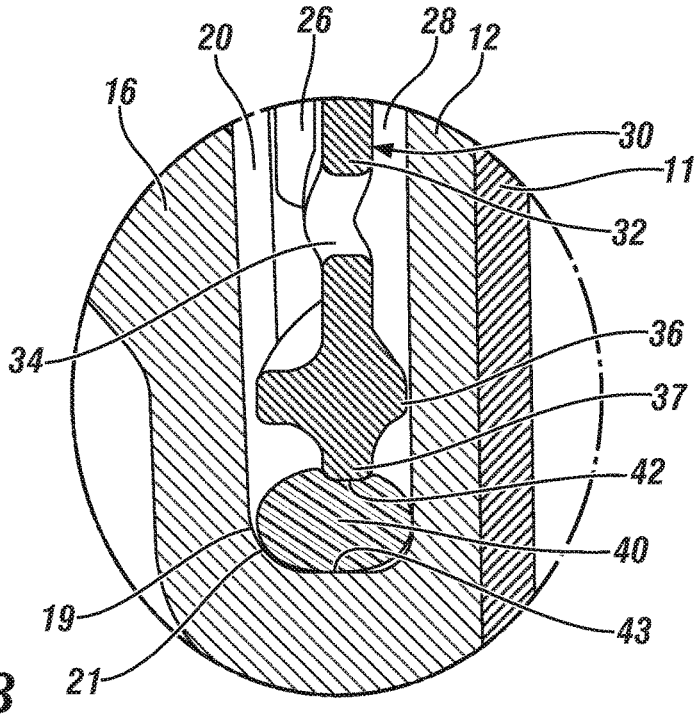

Referring now to the drawings, wherein the depictions are for the purpose of illustrating certain exemplary embodiments only and not for the purpose of limiting the same, FIG. 1 schematically illustrates a top plan view of a multi-cylinder engine block assembly 15 and FIGS. 2A and 2B schematically illustrate a partial cutaway end view of the engine block assembly 15. Like numerals indicate like elements throughout the different views, and like terms indicate like terms throughout the different views.

Note that with regard to the terms "upper" and "lower" directions, "upper" is defined as being in the direction of a cylinder head towards the top of the engine block assembly 15 and "lower" is defined as being in the direction towards a crankcase. Note with regard to the terms "inner" and "outer" directions, "inner" is defined as being in the direction towards a cylinder of the engine block assembly 15 and "outer" is defined as being in the direction away from a cylinder of the engine block assembly 15.

The engine block assembly 15 includes a cast engine block 10 having a plurality of cylindrical openings forming cylinder walls 12 that define a corresponding plurality of cylinder bores 13. As shown, the plurality of cylinder bores 13 includes four of the cylinder bores 13 disposed in series. In one embodiment, the engine block 10 is fabricated from aluminum. Alternatively, the cast engine block is fabricated from cast iron or another suitable material. A cylindrically-shaped liner 11 is inserted into each of the cylinder bores 13 in one embodiment. The liner 11 is fabricated from iron, ceramic or another suitable material.

Outer engine block walls 16 are formed peripheral to outer surfaces of the plurality of the cylinder walls 12, with a channel 20 formed between outer peripheral surfaces of the cylinder walls 12 and the outer engine block walls 16 during casting of the engine block 10. The channel 20 provides a void area for a water jacket to encompass an upper portion of the outer peripheral surfaces of the cylinder walls 12. A water jacket insert 30 is assembled into the channel 20 as a coolant diverter that directs and meters coolant flow through the engine block 10. A portion of the water jacket insert 30 is shown with reference to FIG. 1.

Referring specifically to FIGS. 2A and 2B, the channel 20 is formed between the outer engine block walls 16 and an outer side of the cylinder walls 12 during casting and extends along a portion of a longitudinal axis of the cylinder walls 12. The channel 20 has a cast end 19 including a bottom portion 21 that is formed at a junction of the outer engine block walls 16 and the cylinder walls 12. A first coolant passage 24 is formed adjacent to the outer engine block walls 16 orthogonal to longitudinal axes of the plurality of cylinder bores 13 and fluidly connects to one side of the channel 20. The coolant passage 24 fluidly connects through the outer engine block walls 16 to the channel 20. A second coolant passage 25 is formed adjacent to the outer engine block walls 16 orthogonal to longitudinal axes of the plurality of cylinders and opposite to the first coolant passage 24. The first and second coolant passages 24, 25 are elements of a liquid cooling system that preferably includes an air/fluid heat exchanger in the form of a radiator and a fluidic pump.

The water jacket insert 30 is fabricated from composite material, e.g., high-temperature plastic, and includes an upper flange 35, a strut portion 32 and a lower flange 36. The upper flange 35 portion of the water jacket insert 30 terminates flush with a surface 17 of the engine block 10 that interfaces with an engine head (not shown). The water jacket insert 30 separates the channel 20 into a first or outer coolant chamber 26 and a second or inner coolant chamber 28. The water jacket insert defines the first coolant chamber 26 that fluidly connects to the first coolant passage 24 and the second coolant chamber 28, which is adjacent to outer peripheral surfaces of the cylinder walls 12. Metering orifices 34 are fabricated into the strut portion 32, with at least one metering orifice 34 associated with each of the cylinder bores 13 in one embodiment. As shown, multiple metering orifices 34 are placed longitudinally along the strut portion 32 such that coolant flow is directed and distributed along a length portion of each of the cylinder walls 12. The metering orifices 34 provide a fluidic connection between the first coolant chamber 26 and the second coolant chamber 28. As such, the first and second coolant chambers 26, 28 are fluidly connected through the plurality of metering orifices 34 formed in the strut portion 32. Other aspects and design features of the water jacket insert 30 are known and not described in detail herein.

A compressible or otherwise compliant seal 40 assembles onto an outward face 37 of the lower flange 36 of the water jacket insert 30 via an assembly mechanism 42. The seal 40 includes a sealing portion 43 that conforms to and seals against the cast end 19 of the channel 20 when the water jacket insert 30 is assembled into the channel 20. The seal 40 is a conformally molded or extruded element fabricated from a suitable flexible or compliant material that retains its mechanical properties and provides high stiffness and wear resistance at temperatures ranging from −40° C. to over 200° C., does not degrade in the presence of engine coolant such as ethylene glycol and retains its properties over a service life that is based upon temperature cycles, elapsed time and hours of operation. In one embodiment, the seal 40 may be fabricated from a high-temperature polyamide.

The seal 40 and associated sealing portion 43 may be in any suitable cross-sectional form, including a rounded cross-section that assembles onto the outward face 37 of the lower flange 36 of the water jacket insert 30 and having the sealing portion 43 in the form of an arc that compressibly interferingly fits against and thus conforms to the cast end 19 of the channel 20, as shown in FIG. 2.

Alternatively, the seal 40 may have a cross-section that is T-shaped including a base section that assembles onto the outward face 37 of the lower flange 36 of the water jacket insert 30 and an associated sealing portion in the form of a wiper that compressibly interferingly fits against the cast end 19 of the channel 20.

Alternatively, the seal 40 may have a cross-section that is U-shaped including a first leg of the U-shape that assembles onto the outward face 37 of the lower flange 36 of the water jacket insert 30 and an associated sealing portion in the form of a second leg of the U-shape that compressibly interferingly fits against and thus conforms to the cast end 19 of the channel 20.

Alternatively, the seal 40 may have a cross-section that includes conformable portion(s) projecting laterally therefrom that compressibly interferingly fits against and thus conforms to vertical walls of the cast end 19 of the channel 20 to form a side-to-side barrier to prevent coolant flow between the lower flange 36 and the cast end 19 of the channel 20 when assembled therein.

The assembly mechanism 42 for joining the compressible seal 40 onto the outward face 37 of the lower flange 36 of the water jacket insert 30 can include overmolding or adhesively bonding the compressible seal 40 onto the outward face 37, forming the compressible seal 40 to include a body portion that fits over and around the lower flange 36 and snaps into place or is press-fit into place, forming the lower flange 36 to include a retaining lip and forming the compressible seal 40 to include a retaining portion that can be press-fit or otherwise assembled into the retaining lip. Dimensions of the various elements are application-specific and can be readily developed by skilled practitioners.

The water jacket insert assembled into a channel 20 of an embodiment of the cast engine block 10 that employs a compressible seal 40 attached to a bottom portion or outer face 37 of the lower flange 36 thereof accommodates dimensional variation in the cast end 19. This permits installation of the water jacket insert 30 into the channel 20 to act as a coolant diverter without applying a sealant such as RTV across the outer face 37 of the lower flange 36 or across the channel 20.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An engine block assembly, comprising:

an engine block casting, including:

a plurality of cylinder bores disposed in series, each cylinder having a cylinder wall;

outer engine block walls peripheral to the cylinder walls;

a channel formed between outer peripheral surfaces of the cylinder walls and the outer engine block walls;

a coolant passage fluidly connected through the outer engine block walls to the channel; and a vertically disposed water jacket insert, including:

an upper flange, an intervening strut portion and a lower flange, wherein an outer portion of the upper flange of the water jacket insert is assembled flush with an upper surface of the engine block casting and conforms to a void area that encompasses an upper portion of the outer peripheral surfaces of the cylinder walls;

a plurality of orifices formed in the strut portion; and a compressible seal assembled onto the lower flange of the water jacket insert;

the water jacket insert being assembled into the channel of the engine block casting;

the compressible seal of the water jacket insert conforming to a bottom portion of the channel; and the water jacket insert defining a first coolant chamber fluidly connected to the coolant passage and a second coolant chamber adjacent to the outer peripheral surfaces of the cylinder walls, the first and second coolant chambers being fluidly connected through the plurality of orifices in the strut portion.

2. The engine block assembly of claim 1, wherein the compressible seal assembled onto the lower flange of the water jacket insert comprises the compressible seal assembled onto a bottom portion of the lower flange of the water jacket insert.

3. The engine block assembly of claim 1, wherein the compressible seal assembled onto the lower flange of the water jacket insert comprises the compressible seal adhesively bonded to the lower flange of the water jacket insert.

4. The engine block assembly of claim 1, wherein the compressible seal assembled onto the lower flange of the water jacket insert comprises the compressible seal overmolded onto the lower flange of the water jacket insert.

5. The engine block assembly of claim 1, wherein the compressible seal assembled onto the lower flange of the water jacket insert comprises the compressible seal press-fit onto the lower flange of the water jacket insert.

6. The engine block assembly of claim 1, wherein the plurality of orifices formed in the strut portion comprises at least one of the orifices associated with each of the cylinder bores.

7. The engine block assembly of claim 1, wherein the first and second coolant chambers are fluidly connected only through the plurality of orifices in the strut portion.

8. The engine block assembly of claim 1, wherein the orifice comprises a metering orifice fabricated to effect a predefined coolant flowrate between the first coolant chamber and the second coolant chamber.

9. The engine block assembly of claim 1, further comprising a cylinder liner inserted into each of the cylinder bores adjacent to the cylinder walls.

10. An engine block assembly, comprising:

a multi-cylinder engine block casting, including:

a plurality of cylinder walls peripheral to and defining a plurality of cylinder bores;

outer engine block walls peripheral to an upper portion of the cylinder walls;

a channel formed between outer peripheral surfaces of the upper portion of the cylinder walls and the outer engine block walls;

a coolant passage fluidly connected through the outer engine block walls to the channel; and a vertically disposed water jacket insert, including:

an upper flange, an intervening strut portion and a lower flange, wherein the upper flange is disposed towards a cylinder head and the lower flange is disposed towards a crankshaft of the engine block;

a plurality of orifices formed in the strut portion; and a compressible seal assembled onto a bottom portion of the lower flange of the water jacket insert;

the water jacket insert being assembled into the channel of the engine block casting;

the compressible seal of the water jacket insert conforming to a bottom portion of the channel in the upper portion of the cylinder walls; and the water jacket insert defining a first coolant chamber fluidly connected to the coolant passage and a second coolant chamber adjacent to the outer peripheral surfaces of the upper portion of the cylinder walls, the first and second coolant chambers being fluidly connected through the plurality of orifices in the strut portion.

11. The engine block assembly of claim 10, wherein the compressible seal assembled onto the bottom portion of the lower flange of the water jacket insert comprises the compressible seal adhesively bonded to the bottom portion of the lower flange of the water jacket insert.

12. The engine block assembly of claim 10, wherein the compressible seal assembled onto the lower flange of the water jacket insert comprises the compressible seal overmolded onto the bottom portion of the lower flange of the water jacket insert.

13. The engine block assembly of claim 10, wherein the compressible seal assembled onto the lower flange of the water jacket insert comprises the compressible seal press-fit onto the lower flange of the water jacket insert.

14. The engine block assembly of claim 10, wherein the plurality of orifices in the strut portion comprises at least one of the orifices associated with each of the cylinder bores.

15. The engine block assembly of claim 10, wherein the first and second coolant chambers are fluidly connected only through the plurality of orifices in the strut portion.

16. The engine block assembly of claim 10, wherein the orifice comprises a metering orifice fabricated to effect a predefined coolant flowrate between the first coolant chamber and the second coolant chamber.

17. The engine block assembly of claim 10, further comprising an outer portion of the upper flange of the water jacket insert assembled flush with an upper surface of the engine block.

18. An engine block assembly, comprising:

an engine block casting, including:

a plurality of cylinder walls defining a plurality of cylinder bores;

outer engine block walls annular to an upper portion of the cylinder walls;

the cylinder walls and the outer engine block walls defining a channel in the upper portion of the cylinder walls;

a coolant passage fluidly connected through the outer engine block walls to the channel;

a vertically disposed water jacket insert, including:

an upper flange, an intervening strut portion and a lower flange, wherein the upper flange is disposed towards a cylinder head and the lower flange is disposed towards a crankshaft of the engine block;

a plurality of orifices formed in the strut portion, each orifice associated with one of the cylinder bores;

a compressible seal located at the lower flange of the water jacket insert;

the water jacket insert and the compressible seal assembled into the channel in the upper portion of the cylinder walls of the engine block casting;

the compressible seal conforming between the lower flange of the water jacket insert and a bottom portion of the channel; and the water jacket insert defining a first coolant chamber fluidly connected to the coolant passage and a second coolant chamber adjacent to the upper portion of the cylinder walls, the first and second coolant chambers fluidly being connected only through the orifices.

* * * * *